US006640973B1

(12) United States Patent
Eskelinen

(10) Patent No.: US 6,640,973 B1
(45) Date of Patent: Nov. 4, 2003

(54) STORAGE BOX FOR DOCTOR BLADES EMPLOYED IN SERVICING OF THE FACE OF A ROLL IN A PAPER/BOARD MACHINE

(75) Inventor: Ilkka Eskelinen, Varkaus (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/600,829

(22) PCT Filed: Jan. 20, 1999

(86) PCT No.: PCT/FI99/00036

§ 371 (c)(1),
(2), (4) Date: Jul. 21, 2000

(87) PCT Pub. No.: WO99/37855

PCT Pub. Date: Jul. 29, 1999

(30) Foreign Application Priority Data

Jan. 23, 1998 (FI) ..... 980148

(51) Int. Cl.[7] ..... B65D 85/66
(52) U.S. Cl. ..... 206/395; 206/397; 206/408
(58) Field of Search ..... 206/389, 391, 206/393, 395, 398, 408, 412, 820, 449; 229/109, 125.9

(56) References Cited

U.S. PATENT DOCUMENTS 2,706,592 A * 4/1955 Schaller ..... 206/395
2,780,402 A * 2/1957 Zucker et al. ..... 206/213.1
2,794,588 A * 6/1957 George et al. ..... 229/109
2,819,833 A * 1/1958 Sauer ..... 229/109
3,433,400 A * 3/1969 Hawkins ..... 222/183
3,587,840 A * 6/1971 Hultberg ..... 206/395
3,877,631 A * 4/1975 Lai et al. ..... 229/109
4,623,063 A * 11/1986 Balkin ..... 206/303
4,850,506 A * 7/1989 Heaps et al. ..... 206/386
5,215,192 A * 6/1993 Ram et al. ..... 206/205
5,257,734 A * 11/1993 Bartle ..... 229/109
5,494,168 A * 2/1996 Hart ..... 206/395
5,536,194 A * 7/1996 Larsen et al. ..... 229/108.1

* cited by examiner

*Primary Examiner*—Shian Luong
(74) *Attorney, Agent, or Firm*—Steinberg & Raskin, P.C.

(57) ABSTRACT

The invention concerns a storage box A 0 (10) for doctor blades employed in servicing of the face of a roll in a paper/board machine. The box is a polygon construction, in whose interior the reel (R) formed by doctor blades ($t_1$, $t_2$) has been fitted. Through an opening (11) in a side face of the storage box, the doctor blades ($t_1$, $t_2$, . . . ) can be discharged from the reel (R) placed inside the storage box (10). In its interior, the storage box (10) comprises bearing means, preferably at least one separate disk (10$a_3$'), which has been fitted to revolve freely on the side face of the reel (R) formed by the doctor blades.

17 Claims, 4 Drawing Sheets

STORAGE BOX FOR DOCTOR BLADES EMPLOYED IN SERVICING OF THE FACE OF A ROLL IN A PAPER/BOARD MACHINE

FIELD OF THE INVENTION

The invention concerns a storage box for doctor blades employed in servicing of the face of a roll in a paper/board machine.

BACKGROUND OF THE INVENTION

In prior-art solutions, the doctor blades have been stored in paper mills as straight blades in storage shelves for doctor blades. In such a case, there is a risk that a blade that is constantly exposed is damaged. Even a small dent in the blade face makes the blade unusable.

OBJECTS AND SUMMARY OF THE INVENTION

In the present patent application, an entirely novel solution for storage of blades is suggested. In the present patent application, it is suggested that a storage box be used for doctor blades. The doctor blades have been joined together from their ends, and the blades have been wound onto a reel. Said reel of doctor blades has been inserted into a storage box, and the doctor blades can be taken/pulled out of said storage box by unwinding the reel of doctor blades.

In accordance with the present invention, the storage box consists of two parts: a cover part and a bottom part. The cover part is fitted so that the edges of the cover are placed around the edges of the bottom part. The box is favourably of octagonal shape. According to the invention, separate bearing means which promote the rotation of the reel of doctor blades have been fitted inside the cover part and the bottom part of the box. Since the storage box is favourably made of cardboard, the bearing part has preferably also been made of cardboard. The bearing means preferably comprise two circular disks, against which the side faces of the reel R of doctor blades are placed. One of the circular disks has been fitted freely against one side face of the reel of doctor blades, and the other disk against the other side face. Further, one of the circular disks has been fitted to be placed against a backup bearing part, which is also made of cardboard. Favourably, both faces of both of the circular disks have been treated with a coating which reduces the friction. The coated bearing face of the circular disk is placed against a preferably likewise coated backup bearing face. One preferably silicon-coated backup bearing face for the circular disk $\mathbf{10}a_3'$ is the plane face of a backup bearing part $\mathbf{10}a_3''$, and a second preferably silicon-coated backup bearing face for the other circular disk $\mathbf{10}a_{30}'$ is the inside plane face of the bottom part $\mathbf{10}a_1$.

The backup bearing part $\mathbf{10}a_3''$ has been formed out of an octagonal plate so that the fold parts of the plate have been bent into an angle of 90° against the bottom face of the middle area of the plate. Said folded edges form a bearing face at the outer circumference of the reel R of doctor blades. Thus, the friction between the side face of the reel of doctor blades and the outer circumference is reduced. The other circular disk $\mathbf{10}a_{30}'$ has been fitted between the other side face of the reel R of doctor blades and the inner face of the bottom $\mathbf{10}a_1$.

Thus, the storage box is provided with inside bearing means, which permit easy rotation of the reel of doctor blades and easy discharge of the reel, i.e. easy pulling of blades out of the interior of the box. The box operates all the time as a storage box until the last doctor blade has been pulled out of the interior of the box.

The storage box in accordance with the invention for doctor blades is characterized in what is stated in the patent claims.

BRIEF DESCRIPTION OF THE DRAWINGS

The invention will be described in the following with reference to some preferred embodiments of the invention illustrated in the figures in the accompanying drawings, the invention being, yet, not supposed to be confined to said embodiments alone.

DETAILED DESCRIPTION OF THE INVENTION

Figure 1A:
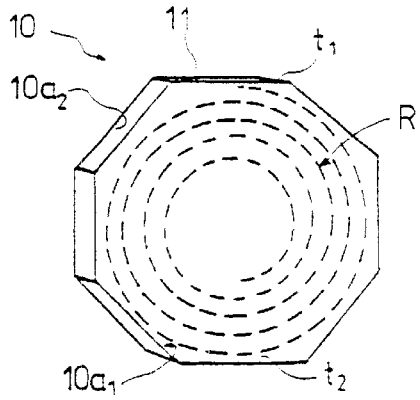
FIG. 1A shows a storage box 10 in accordance with the invention for doctor blades as assembled. In its interior the storage box 10 includes a reel R composed of doctor blades $t_1$, $t_2$ . . . , which can be discharged through an opening provided in the side face of the storage box.

FIG. 1A is an axonometric view of a storage box 10 in accordance with the invention. The storage box 10 is favourably octagonal, and the material is corrugated board, cardboard, relatively stiff plastic, or equivalent. As is shown in the figure, the reel R of doctor blades can be discharged out of the storage box 10 through the discharge opening 11.

Figure 1B:
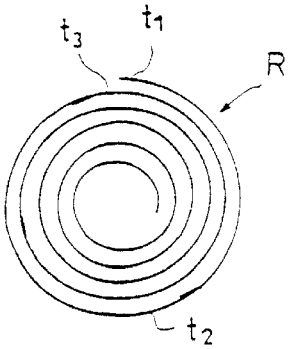
FIG. 1B illustrates a reel R of doctor blades consisting of doctor blades $t_1$, $t_2$.

FIG. 1B is an illustration of principle of formation of a reel R of doctor blades so that the doctor blades $t_1$, $t_2$ . . . are joined together by means of a binding strap from their ends while the blade ends overlap each other.

Figure 1C:
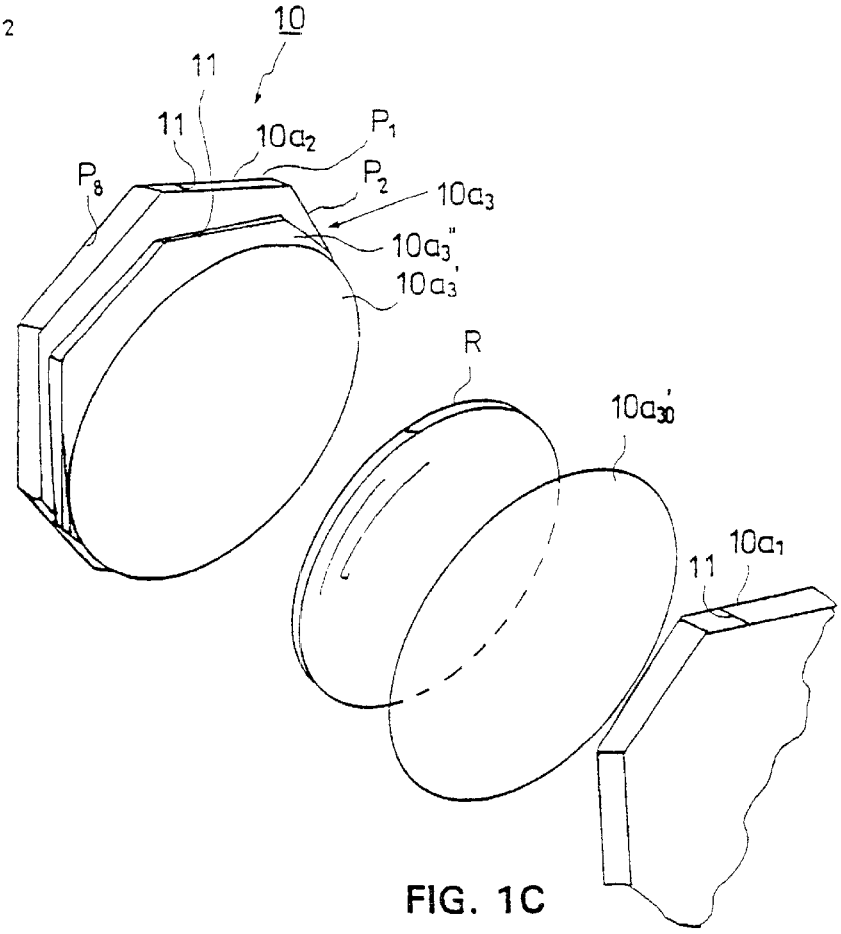
FIG. 1C is an exploded view of a storage box for doctor blades.

FIG. 1C shows the storage box 10 as disassembled into its parts $\mathbf{10}a_1$, $\mathbf{10}a_2$ and $\mathbf{10}a_3$. The storage box 10 comprises a bottom part $\mathbf{10}a_1$, a cover part $\mathbf{10}a_2$, and bearing means $\mathbf{10}a_3$ placed in the interior of the box, which bearing means consist of a first bearing disk $\mathbf{10}a_3'$, preferably a circular disk, and of a backup bearing part $\mathbf{10}a_3''$, and of a second bearing disk $\mathbf{10}a_{30}'$, preferably a circular disk. The disk faces of both circular disks $\mathbf{10}a_3'$, $\mathbf{10}a_{30}'$ have been coated with a material that reduces friction, favourably silicon. Similarly, the face planes of the backup bearing part $\mathbf{10}a_3''$ and of the bottom part $\mathbf{10}a_1$, against which the circular disks $\mathbf{10}a_3'$, $\mathbf{10}a_{30}'$ will be placed, have been coated with a material that reduces friction, favourably silicon. As is shown in the figure, the storage box 10 is favourably octagonal, and so it can be placed readily on support of one of its side faces, in which case the doctor blades can be discharged from the reel R of doctor blades placed in the interior of the box through the through opening 11 provided in the side face of the storage box. The through openings 11 are placed in the same locations one above the other in the parts $\mathbf{10}a_2$, $\mathbf{10}a_1$ and $\mathbf{10}a_3''$, so that the doctor blades $t_1$, $t_2$ . . . can be discharged from the reel R through the openings 11 provided in the parts $\mathbf{10}a_2$, $\mathbf{10}a_1$ and $\mathbf{10}a_3''$ of the storage box 10.

Figure 2A:
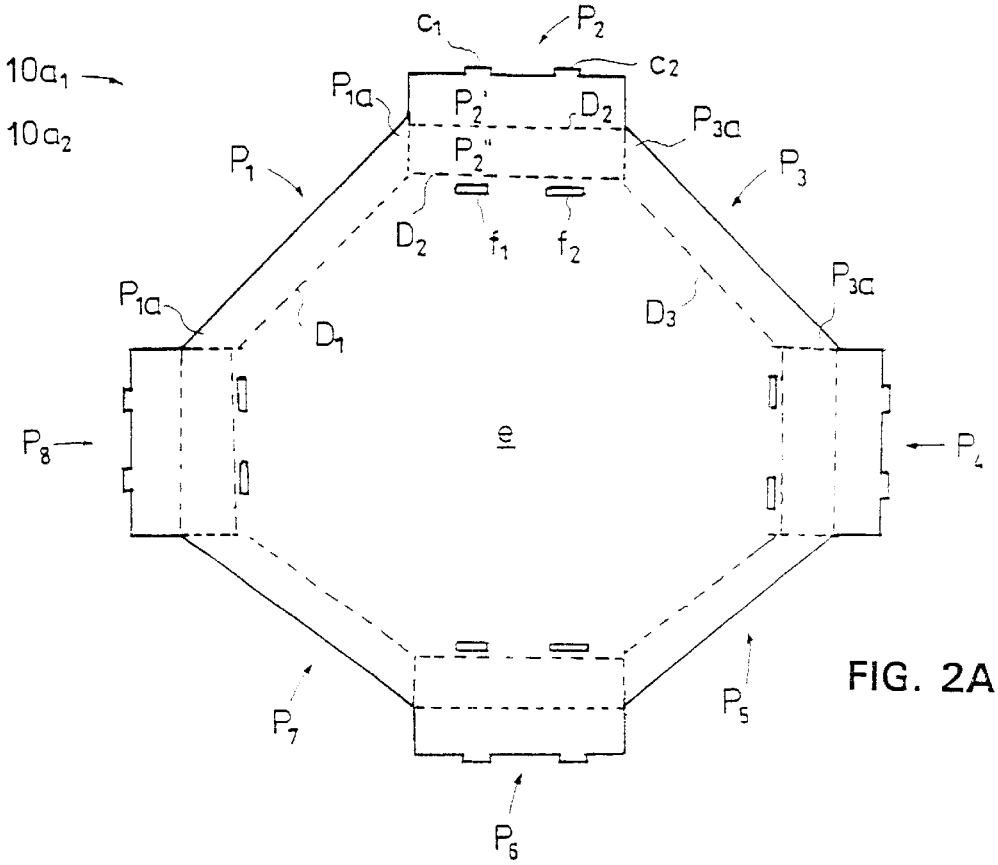
FIG. 2A shows the bottom/cover part of the storage box as spread out.

FIG. 2A is a spread-out illustration of the bottom part $\mathbf{10}a_1$ and the cover part $\mathbf{10}a_2$ of the storage box. The bottom part $\mathbf{10}a_1$ and the cover part $\mathbf{10}a_2$ comprise eight edge parts, i.e. the edge parts $P_1$, $P_2$, $P_3$, $P_4$, $P_5$, $P_6$, $P_7$, and $P_8$. The edge parts are provided with creases $D_1$, $D_2$, $D_3$ . . . $D_8$. The fold lines of the creases $D_1$, $D_2$, $D_3$ . . . $D_8$; $D_2'$, $D_4'$ . . . $D_8'$ form an octagon when the spread-out illustration of the part is viewed from above. At the edges of the bottom area e of the box, in connection with every second edge part $P_2$, $P_4$, $P_6$ . . . , there are corresponding slots $f_1$, $f_2$, and the fold edge $P_2'$ connected with the edge part $P_2$ related to said slots $f_1$, $f_2$ . . . can be folded so that the locking tongues $c_1$, $c_2$ . . . connected with said fold edge are inserted in the slots $f_1$, $f_2$.

When the box is assembled, the edge parts $P_1$, $P_2$ . . . $P_8$ are raised so that they are perpendicular to the face plane of the bottom area e. Every second edge part $P_1$, $P_3$ is folded so that, for example, the ends $P_{1a}$, $P_{3a}$ . . . , which are inclined in relation to the directions or lines of the creases $D_1$, $D_3$, are placed between the edge parts $P_2$, $P_2'$; $P_4$, $P_4'$ . . . of the adjacent edge sectors. The edge tongues $c_1$, $c_2$ of the fold edge $P_2'$ are locked in the corresponding slots $f_1$, $f_2$ in the middle part e. The inclined end $P_{1A}$ of the edge part $P_1$ is locked between the edge parts $P_2$, $P_2'$.

Figure 2B:
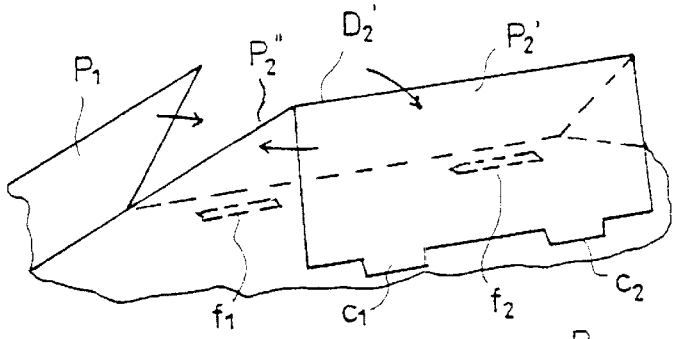
FIG. 2B illustrates folding of the edges of the bottom/cover part along the creases so that the edge parts are formed perpendicularly to the middle area while the edge parts are locked in slots placed at the edges of the middle area.

FIG. 2B illustrates the formation of the bottom part $\mathbf{10}a_1$, and so also of the cover part $\mathbf{10}a_2$, of the storage box 10 for doctor blades so that the edge parts $P_1$, $P_2$, $P_2'$ are folded in the way described above so that the edge tongues $c_1$, $c_2$ of the edge parts $P_2'$ are fitted into the corresponding slots $f_1$, $f_2$ in the bottom area e. The construction of the cover part $\mathbf{10}a_2$ is equal to the construction of the bottom part $\mathbf{10}a_1$. The cover part $\mathbf{10}a_2$ has larger measures than the part $\mathbf{10}a_1$, and so the cover part $\mathbf{10}a_2$ is fitted around the bottom part $\mathbf{10}a_1$.

Figure 2C:
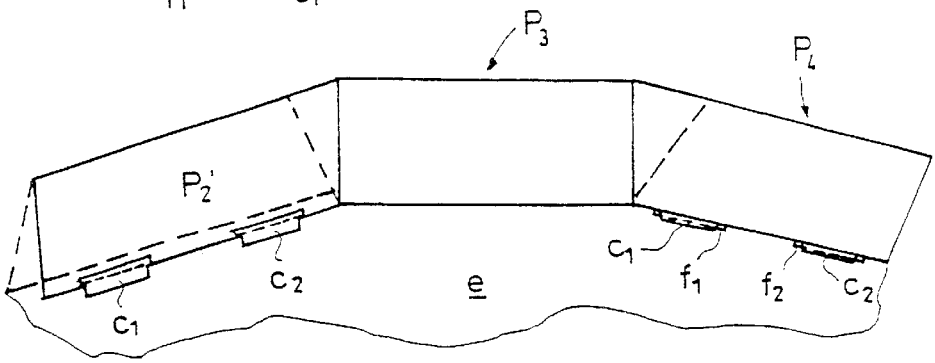
FIG. 2C shows the second stage of folding, i.e. interlocking of adjacent edge parts with each other.

FIG. 2C illustrates the part $\mathbf{10}a_1$, $\mathbf{10}a_2$ as folded together, i.e. the ultimate stage of folding following after the stage shown in FIG. 2B.

Figure 3A:
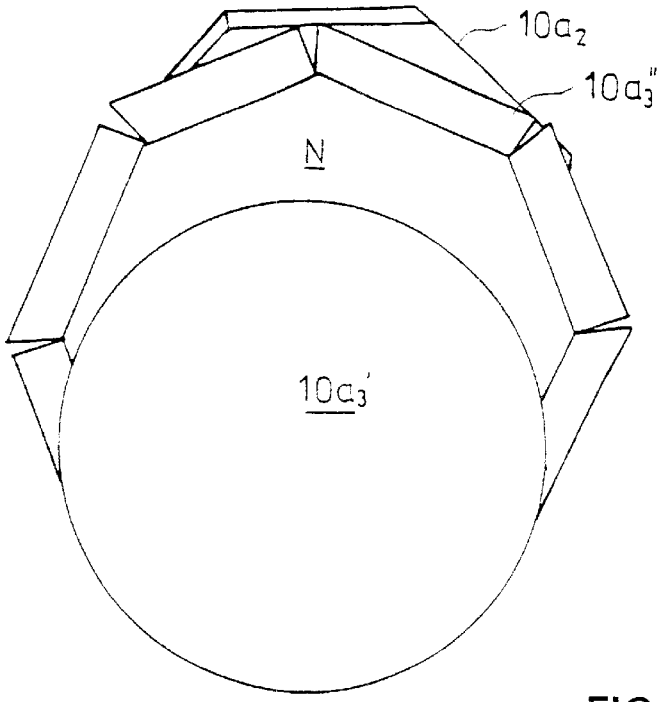
FIG. 3A illustrates formation of the bearing part out of two jointly operative structural components. The illustration in the figure is an axonometric view in part.

FIG. 3A illustrates formation of the bearing part $\mathbf{10}a'_3$. The bearing part $\mathbf{10}a_3$ comprises a bearing part $\mathbf{10}a_3'$, which is placed against the backup bearing part $\mathbf{10}a_3''$. The part $\mathbf{10}a_3'$ is a circular disk, whose outer face is provided with a coating, preferably a silicon coating, which reduces the friction. The outer face of the circular disk $\mathbf{10}a_3'$ enters into contact with the backup bearing face N of the backup bearing part $\mathbf{10}a_3''$. Said face N has also been treated favourably with a material that reduces friction, preferably provided with a coating, preferably a silicon coating.

Figure 3B:
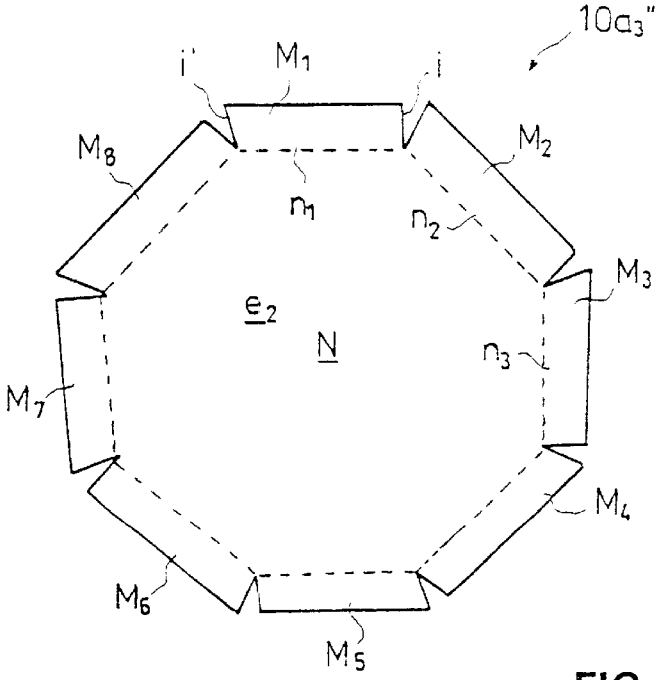
FIG. 3B is a spread-out illustration of a backup bearing part.

FIG. 3B is a spread-out illustration of the part $\mathbf{10}a_3''$. The part $\mathbf{10}a_3''$ is likewise made of an octagonal construction, and it comprises eight edge parts $M_1$, $M_2$, $M_3$ . . . $M_8$. The edge parts $M_1$ . . . $M_8$ are placed at the outer edge of the middle area $e_2$ of the plate part $\mathbf{10}a_3''$, and they are provided with creases or crease lines $n_1$, $n_2$ . . . $n_8$. The edge part $M_1$, $M_2$ . . . is provided with end edges i, which are placed perpendicularly to the creases $n_1$, $n_2$ . . . , and with second end edges i', which are placed as inclined in relation to said crease lines $n_1$, $n_2$ . . . .

Figure 3C:
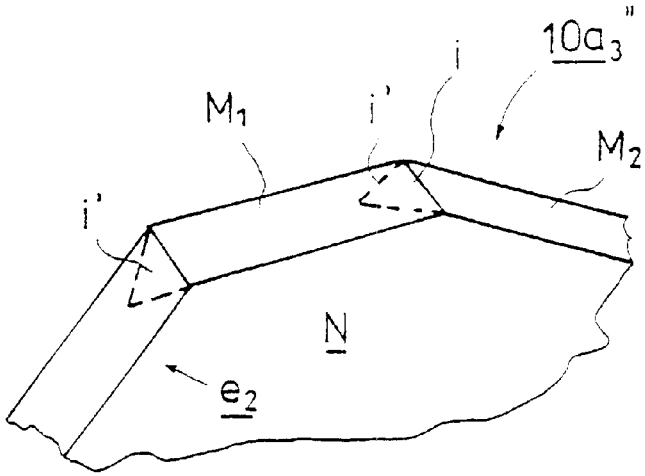
FIG. 3C illustrates folding of the edges of the backup bearing part perpendicularly to the middle area in order to form the edge portion of the bearing arrangement.

As is shown in FIG. 3C, the edge parts $M_1$, $M_2$ . . . of the part $\mathbf{10}a_3''$ are folded so that they are perpendicular to the plane of the middle area $e_2$, in which case, for example, the inclined end edge i' of the edge part $M_1$ is placed underneath the end edge i of the adjacent edge part $M_8$.

Figure 3D:
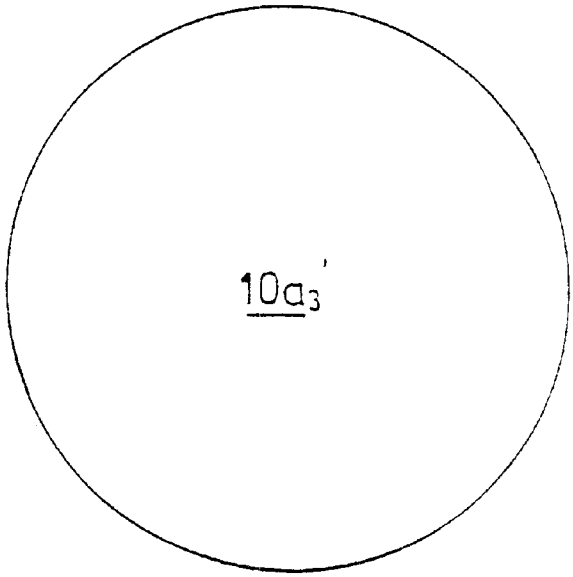
FIG. 3D shows a bearing part, favourably a circular disk.

FIG. 3D shows the bearing disk $\mathbf{10}a_3'$ or $\mathbf{10}a_{30}'$ as a separate illustration.

What is claimed is:

1. A storage box (10) for doctor blades employed in servicing of the face of a roll in a paper or board machine, which box is a polygon construction and in whose interior the reel (R) formed by doctor blades ($t_1$, $t_2$) has been fitted, and from which box, through an opening (11) in a side face of the box, the doctor blades ($t_1$, $t_2$ . . . ) can be discharged from the reel (R) placed inside the storage box (10), wherein in the interior of the storage box (10) comprises bearing means ($\mathbf{10}a_3$), including a separate disk ($\mathbf{10}a_3'$, $\mathbf{10}a_{30}'$), which has been fitted to revolve freely on the side face of the reel (R) formed by the doctor blades;

wherein the bearing part ($\mathbf{10}a_3'$) has been fitted to be placed against a face (N) of a backup bearing part ($\mathbf{10}a_3''$) of the bearing means ($\mathbf{10}a_3$), which backup bearing part ($\mathbf{10}a_3''$) comprises edge parts ($M_1$, $M_2$ . . . ) in which connection the real (R) formed by doctor blades has been fitted in the area between edge parts ($M_1$, $M_2$ . . . ) and a middle area (e) of a plate part ($\mathbf{10}a_3''$), are the bearing part ($\mathbf{10}a_3'$) has been fitted between the reel (R) formed by doctor blades and the middle area ($e_2$) of the plate part ($\mathbf{10}a_3''$), in which case the inner faces of the edge parts ($M_1$, $M_2$) form a bearing face for the circumferential face of the reel (R) of doctor blades.

2. A storage box as claimed in claim 1, wherein the bearing part ($\mathbf{10}a_3'$) is a circular disk.

3. A storage box for doctor blades as claimed in claim 1, wherein there are two circular disk parts ($\mathbf{10}a_3'$, $\mathbf{10}a_{30}'$), and that said disk parts have been meant to be fitted at both sides of the reel (R) of doctor blades formed by the doctor blades ($t_1$, $t_2$).

4. A storage device as claimed in claim 1, wherein the bearing part ($\mathbf{10}a_3'$) is provided with a coating.

5. A storage box as claimed in claim 1 wherein the material of the storage box and of the bearing parts related to said box is preferably corrugated board, cardboard, relatively stiff plastic, or equivalent.

6. A storage device as claimed in claim 3, wherein the coating is a silicon coating.

7. A storage device as claimed in claim 1, wherein the backup bearing part ($\mathbf{10}a_3''$) is provided with a coating.

8. A storage device as claimed in claim 4, wherein the coating is a silicon coating.

9. A storage box (10) for doctor blades employed in servicing of the face of a roll in a paper or board machine, which box is a polygon construction and in whose interior the reel (R) formed by doctor blades ($t_1$, $t_2$) has been fitted, and from which box, through an opening (11) in a side face of the box, the doctor blades ($t_1$, $t_2$ . . . ) can be discharged from the reel (R) placed inside the storage box (10), wherein in the interior of the storage box (10) comprises bearing means ($\mathbf{10}a_3$), including a separate disk ($\mathbf{10}a_3'$, $\mathbf{10}a_{30}'$), which has been fitted to revolve freely on the side face of the reel (R) formed by the doctor blades;

wherein edge parts ($M_1$, $M_2$, $M_3$ . . . ) of a backup bearing part ($\mathbf{10}a_3''$) have been folded perpendicularly to a middle area ($e_2$) of a plate part ($\mathbf{10}a_3''$), and they are placed so that their end edges (I, I') overlap each other.

10. A storage box for doctor blades employed in the servicing of the surface of a roll in a paper or board machine, said storage box comprising:

a box body having polygonal construction including a bottom;

a cover adapted to fit over the bottom;

said box body being structured and arranged to receive a reel for discharging doctor blades;

said box body having a slot in a perimeter thereof, said slot being structured and arranged to permit the passage of said doctor blades to thereby permit the discharge of said doctor blades from said box; and bearing means adapted to fit within said box and permitting said reel of doctor blades to revolve freely within said box, wherein said bearing means comprises:

a back-up bearing part having a polygonal construction to thereby conform to the shape of said storage box, a contact surface and a plurality of edge parts extending from a perimeter of said contact surface, said edge parts being arranged perpendicularly to said contact surface thereby defining a middle area, said back-up bearing part being structured and arranged to fit within said storage box; and a first and second contact plate each having a terminal edge, first and second surfaces and each being adapted to fit within said middle area of said back-up part said first contact plate being structured and arranged within said back-up part, said first surface of said first contact plate contacting said reel and said second surface of said first contact plate contacting said back-up part, said second contact plate being structured and arranged with said back-up part, said first surface of said second contact plate contacting said reel and said second surface of said second contact plate contacting said bottom of said storage box, and said terminal edges of each of said first and second contact plates resting against said edge parts to thereby retain said reel of doctor blades therebetween.

11. The storage box according to claim 10, wherein said bearing means is a separate disk.

12. The storage box according to claim 11, wherein said separate disk is circular.

13. The storage box according to claim 9, wherein said contact plates are circular.

14. The storage box according to claim 13, wherein said plates are provided with a coating that reduces friction.

15. The storage box according to claim 10, wherein said back-up bearing part is provided with a coating of lubricant.

16. The storage box according to claim 10, wherein said box, back-up bearing part and contact plates are made of a material selected from the group consisting of corrugated cardboard, cardboard, plastic and metal.

17. The storage box according to claim 10, wherein each of said edge parts are formed with a contact flap extending from one side edge of said edge part, said flap extending parallel to a perimeter of said contact plate, whereby when said edge part is folded perpendicular to said contact plate, said contact flap from one edge part overlaps an adjacent edge part therein providing a surface against which adjacent edge parts can be fixedly held together.

* * * * *